United States Patent [19]

Prete, Jr. et al.

[11] Patent Number: 4,567,628

[45] Date of Patent: Feb. 4, 1986

[54] CAM BUCKLE ASSEMBLY FOR USE IN TYING DOWN LOADS

[75] Inventors: Ernest Prete, Jr., Woodland Hills; Howard T. Knox, Simi, both of Calif.

[73] Assignee: Ancra Corporation, El Segundo, Calif.

[21] Appl. No.: 657,887

[22] Filed: Oct. 5, 1984

[51] Int. Cl.[4] ..... A44B 11/12; A44B 21/00

[52] U.S. Cl. ..... 24/68 CD; 24/68 E; 24/170; 24/191; 24/199

[58] Field of Search ..... 24/68 CD, 68 R, 68 CT, 24/68 E, 265 CD, 270, 271, 273, 193, 192, 191, 170, 173, 231, 241 SL

[56] References Cited

U.S. PATENT DOCUMENTS

| | | | |
|---|---|---|---|
| 382,796 | 5/1888 | Brown | 24/231 |
| 2,285,714 | 6/1942 | Hirsh | 24/199 |
| 2,822,595 | 2/1958 | Ruhl | 24/193 |
| 2,852,827 | 9/1958 | Arnold | 24/68 CT |
| 2,981,993 | 5/1961 | Elsner | 24/193 |
| 2,997,761 | 8/1961 | Davis | 24/68 E |
| 2,998,626 | 9/1961 | Prete, Jr. | 24/170 |
| 3,686,715 | 8/1972 | Brondnicki | 24/68 CD |
| 3,866,272 | 2/1975 | Prete, Jr. et al. | 24/68 CD |
| 4,373,234 | 2/1983 | Boden | 24/191 |
| 4,424,611 | 1/1984 | Mori | 24/192 |

FOREIGN PATENT DOCUMENTS

| | | | |
|---|---|---|---|
| 1482077 | 5/1967 | France | 24/273 |

*Primary Examiner*—Victor N. Sakran

*Attorney, Agent, or Firm*—Edward A. Sokolski

[57] ABSTRACT

A cam buckle assembly has a main body portion fabricated of a suitable resilient material such as a resilient plastic. A cam member is pivotally assembled in the main body portion and is resiliently urged towards the main body portion by a resilient arm member which extends from the main body portion and abuts against the cam member. A strap is wound around a cross arm formed in the main body portion at one end thereof, this strap being adjustable as to its effective length and once so adjusted retained in such position by means of the cam member. Means are provided at the other end of the body portion, for attaching the body portion to securing means which in one embodiment comprises a resilient hook and in another embodiment a cross bar for receiving an attachment strap.

14 Claims, 7 Drawing Figures

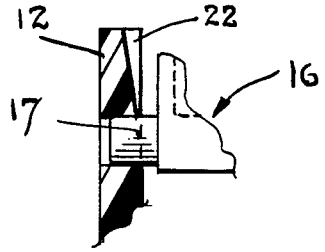
FIG. 3A
FIG. 2
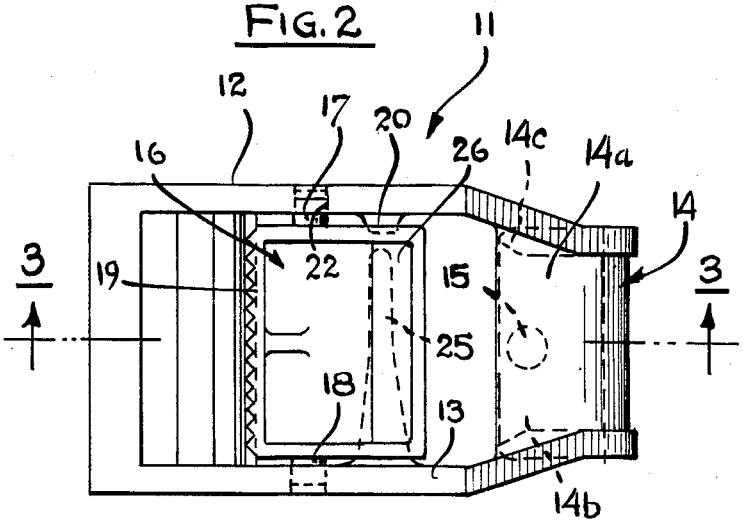
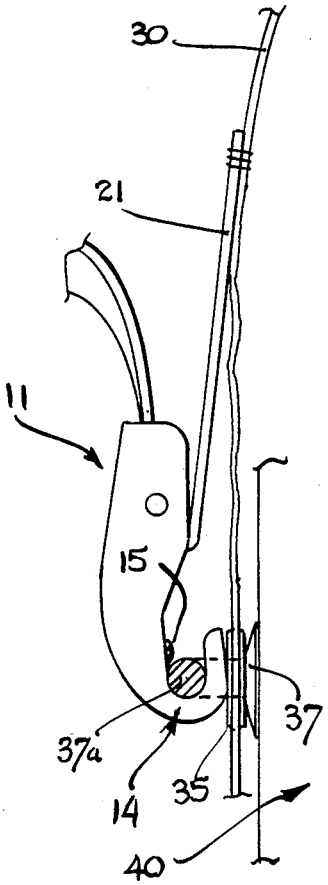
FIG. 1
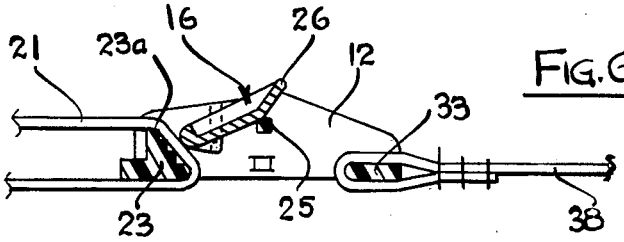
FIG. 6
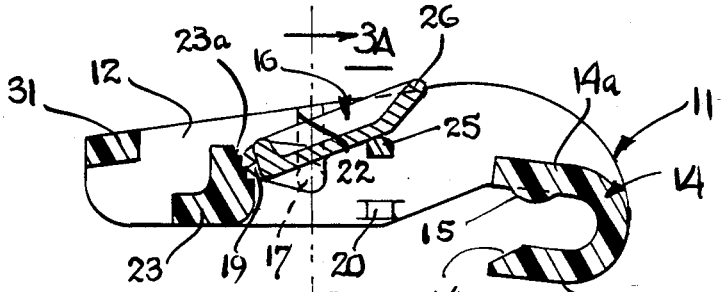
FIG. 3 3A
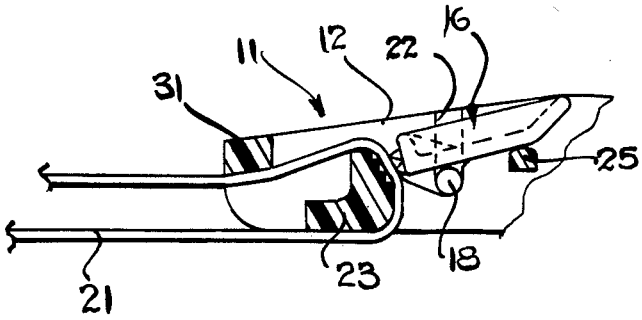
FIG. 4
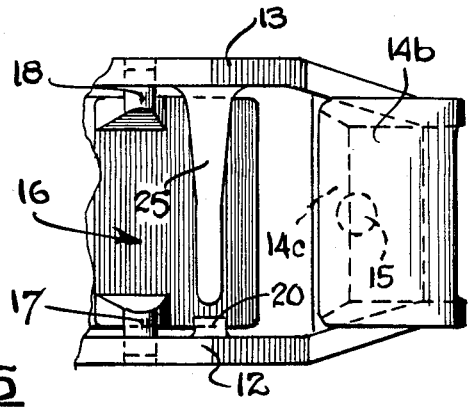
FIG. 5

CAM BUCKLE ASSEMBLY FOR USE IN TYING DOWN LOADS

This invention relates to buckle assemblies for use in conjunction with straps to retain an object in a desired position and more particularly to such a device which employs a cam member which is resiliently urged against one of the straps by a resilient arm member extending from the main body of the assembly.

Various types of buckle devices have been used in the prior art for retaining tarps in place over cargo or other objects to be protected against the elements. These prior art devices generally incorporate a buckle through which a strap may be reeved and adjusted as to its length, the strap being stitched to the tarp at one end or otherwise attached thereto. The buckle in many of these prior art devices has attachment means connected to one end which may comprise a hook which fits over the arm of a U-shaped anchoring bracket. Such devices of the prior art have several shortcomings. First, the hooks employed can readily become detached from the bracket should the tension on the strap loosen. This of course could result, particularly under windy conditions, in the tarp becoming detached. Also, such hooks in prior art devices are generally a separate piece which must be attached to the end of the buckle which adds to the cost of the device. Further, many of such prior art devices are overly expensive in their construction. In addition in some of such devices the tensioning of the strap is not as easy to accomplish as would be desired.

The device of the present overcomes the aforementioned shortcomings of the prior art in providing a simple highly economical buckle device which in one embodiment, while easily attachable to and removable from an anchoring bracket, nevertheless snaps onto the bracket and has retention means thereon which resists detachment from the bracket except by the application of a substantial positive force. Further, the device of the invention employs a unique camming assembly for retaining the adjustable strap which is highly effective and of economical construction.

The improvement is achieved in the present invention by employing a main body portion fabricated of a resilient material such as a suitable plastic. In one embodiment a hook also of such resilient material is integral with and extends from the main body portion, there being a detent in the form of a protuberance on an inside wall of one of the arms of the hook which enables a snap fit of the hook on an anchoring bracket. Further, the adjustment strap for use in tightening the tarp over the load is wound over only a single cross arm of the hook member and is adjustably retained in position on this cross arm by means of a cam member which is pivotally supported on the main body of the hook assembly and resiliently urged against the strap by means of a resilient finger member extending from the main body portion of the assembly. The cam member can be pivotally urged away from the strap member by applying finger pressure thereto against the urging of the resilient finger to free the strap for tensioning or loosening.

It is therefore an object of this invention to provide a buckle member for retaining a strap which is of simpler and more economical construction.

It is a further object of this invention to provide a buckle assembly for retaining a strap to an anchoring bracket member which has an integral hook member with means thereon for removably retaining the hook member to the bracket member. It is still another object of this invention to provide a buckle assembly for retaining a strap to an anchoring bracket or the like in which the tensioning or releasing of the strap can more simply be achieved.

Other objects of this invention will become apparent as the description proceeds in connection with the accompanying drawings of which:

FIG. 1 is a side elevational drawing illustrating the use of a first embodiment of the invention in retaining a tarp in position;

FIG. 2 is a top plan view of the first embodiment;

FIG. 3 is cross-sectional view taken along the plane indicated by 3—3 in FIG. 2;

FIG. 3A is a cross-sectional view taken along the plane indicated by 3A—3A in FIG. 3;

FIG. 4 is a partial side elevational view in cross-section of the first embodiment showing the operation of the cam member, FIG. 5 is a partial bottom plan view of the first embodiment, and FIG. 6 is a side elevational view in cross section of a second embodiment of the invention.

Referring now to the drawings, main body portion 11 is made of a resilient material such as a suitable polycarbonate plastic. The hook member has a pair of oppositely positioned side arms 12 and 13 which are substantially parallel to each other through most of their extent, the forward ends of the arms running into a hook 14. Hook 14 has opposite arms **14*a* and 14*b*, arm 14*b* having a ramp 14*c* formed on the free end thereof. Formed on the inner wall of arm 14*a* is a arcuate protuberance 15. Cam member 16 is pivotally supported by means of pivot pins 17 and 18 integrally formed therewith which extend outwardly from the opposite sides thereof and fit into mating apertures formed in arms 12 and 13 respectively. Cam member 6 is snapped into position in the apertures formed in the arms by first placing pin 17 in its associated aperture and then sliding pin 18 along slot 22 formed in arm 13 until it finally snaps into position in its associated aperture. Cam member 16 may be fabricated of metal or plastic and has a plurality of teeth 19 along one side thereof for engagement with strap 21 which is reeved around cross arm 23 which extends between arms 12 and 13. Serrations 23*a* are formed along the inner wall of cross arm 23 to aid in retaining the strap in position between the cam member and the cross arm. Strap 21 is retained between cam member 16 and cross arm 23 by virtue of the resilient action of resilient arm 25 which extends from side arm 13 and abuts against cam member 16. A lever 26 is provided along the edge of cam member 16 opposite to that on which teeth 19 are formed. A stop member 20 extends inwardly from arm 12 and acts to limit the travel of cam member 16. Outer guide bar 31 is provided between arms 12 and 13** to facilitate the guiding and retention of the strap.

Referring now particularly to FIGS. 1 and 4 the use of the hook member of the invention in retaining a tarp 30 in place is illustrated. Strap 21 is stitched or otherwise attached to the tarp, the free end of the strap being reeved around cross member 23 of the assembly. The strap is tensioned by pulling on the free end thereof while the cam 16 is being depressed by means of lever 26. The strap is held in this tensioned position be means of the cam between cam teeth 19 and the serrations **23*a* of arm 23. The end of the tarp has an eye hook 35 thereon which fits over anchoring bracket 37 which is fixedly supported on a support structure 40**. The hook 14 is snapped into position over the bar portion 37*a* of the bracket by virtue of its resiliency and is retained in this position by virtue of arcuate protuberance or detent 15 formed on the hook. The hook is readily removable from the bracket but only by the application of positive manual pressure in a downward direction with strap 21 in an untensioned state.

Referring now to FIG. 6, a second embodiment of the invention is illustrated. This embodiment is similar to the first embodiment except for the elimination of the hook member 14 and guide bar 31 and the substitution of a cross bar 33 for use in attaching a strap 38 to one end of the buckle. In this second embodiment, the strap 38 can be attached to suitable anchoring means, as may be desired. Otherwise, the operation and construction of the buckle of the second embodiment is the same as that of the first.

While the invention has been described and illustrated in detail, it is to be clearly understood that this is intended by way of illustration and example only and is not to be taken of way of limitation, the spirit and scope of the invention being limited only by the terms of the following claims.

I claim:

1. A buckle assembly for retaining a strap, for use in tying down a load to a support bar or the like comprising:

a resilient main body portion;

a cam member;

means for pivotally supporting the cam member on the main body portion, means on said main body portion for supporting the strap, the strap being retained on said main body portion between said last mentioned main body means and said cam member, means extending from said main body portion for resiliently urging the cam member towards said main body portion means to clamp the strap between the cam member and the main body portion, and a resilient hook extending from the main body portion, said hook having opposing broad surfaced arms, one of said arms having a detent in the shape of an arcuate protuberance formed on the side thereof facing the other of said arms, said hook being snap fitted on said support bar with the detent operating to retain said hook on said bar.

2. The assembly of claim 1 wherein said means for supporting the strap comprises a cross arm on said main body portion around which the strap is reeved, the cross arm having serrations formed thereon and the cam member having teeth formed thereon for aiding the retention of the strap.

3. The assembly of claim 1 wherein the means for resiliently urging the cam member comprises a resilient arm extending from the main body portion and abutting against the cam member.

4. The assembly of claim 3 and further including stop means extending from the main body portion for limiting the travel of the cam member.

5. The assembly of claim 1 wherein the main body portion comprises a pair of opposite side arms between which the cam member is pivotally supported.

6. The assembly of claim 1 wherein the main body portion is integrally formed with said hook of a resilient plastic material.

7. The assembly of claim 5 wherein the means for pivotally supporting the cam member comprises a pair of pivot pins extending outwardly from the opposite sides of said cam member, a pair of mating apertures for said pivot pins being formed in said side arms, a slot being formed in at least one of said side arms adjacement to the associated aperture, an associated one of said pins being slided along said slot to snap into place in said associated aperture.

8. The assembly of claim 5 and further including a guide bar extending between said side arms to facilitate the guiding and clamping of the strap.

9. A buckle assembly for retaining a strap, for use in tying down a load comprising:

a resilient main body portion having a pair of oppositely positioned spaced apart side arms;

a cam member, means for pivotally supporting the cam member on the main body portion between the side arms thereof;

means on said main body portion for supporting the strap, the strap being retained on said main body portion between said last mentioned main body portion means and said cam member;

resilient arms means extending laterally from one of the side arms of said main body portion alongside and abutting against the cam member for resiliently urging the cam member towards said main body portion means to clamp the strap between the cam member and the main body portion.

10. The assembly of claim 9 wherein said means for supporting the strap comprises a cross arm on said main body portion around which the strap is reeved, the cross arm having serrations formed thereon and the cam member having teeth formed thereon for aiding the retention of the strap.

11. The assembly of claim 9 and further including stop means extending from the main body portion for limiting the travel of the cam member.

12. The assembly of claim 9 wherein the main body portion comprises a pair of opposite side arms between which the cam member is pivotally supported.

13. The assembly of claim 12 wherein the means for pivotally supporting the cam member comprises a pair of pivot pins extending outwardly from the opposite sides of said cam member, a pair of mating apertures for said pivot pins being formed in said side arms, a slot being formed in at least one of said side arms adjacement to the associated aperture, an associated one of said pins being slided along said slot to snap into place in said associated aperture.

14. The assembly of claim 12 and further including a guide bar extending between said side arms to facilitate the guiding and clamping of the strap.

* * * * *